United States Patent [19]

Kisling et al.

[11] Patent Number: 4,558,988

[45] Date of Patent: Dec. 17, 1985

[54] ROTOR DISK COVER PLATE ATTACHMENT

[75] Inventors: Douglas L. Kisling, Palm Beach Gardens; Edward C. Hill, Tequesta, both of Fla.; Ronald D. Delahoussaye, Ruston, La.

[73] Assignee: United Technologies Corporation, Hartford, Conn.

[21] Appl. No.: 564,453

[22] Filed: Dec. 22, 1983

[51] Int. Cl.[4] ..... F01D 5/30

[52] U.S. Cl. ..... 416/220 R; 416/193 A

[58] Field of Search ..... 416/193 A, 220 R, 221, 416/95

[56] References Cited

U.S. PATENT DOCUMENTS

| | | | |
|---|---|---|---|
| 3,096,074 | 7/1963 | Pratt et al. | 416/221 X |
| 3,663,118 | 5/1972 | Johnson | 416/221 X |
| 4,171,930 | 10/1979 | Brisken | 416/193 A X |
| 4,192,633 | 3/1980 | Herzner | 416/500 X |
| 4,304,523 | 12/1981 | Corsmeier et al. | 416/221 |
| 4,349,318 | 9/1982 | Libertini et al. | 416/220 R |
| 4,432,555 | 2/1984 | Langley | 416/174 X |
| 4,470,756 | 9/1984 | Rigo et al. | 416/220 R |

FOREIGN PATENT DOCUMENTS

| | | | |
|---|---|---|---|
| 26211 | 2/1982 | Japan | 416/220 R |

*Primary Examiner*—Everette A. Powell, Jr.

*Attorney, Agent, or Firm*—Stephen E. Revis

[57] ABSTRACT

A device for securing an annular blade retaining plate to a rotor disk includes an annular groove around the disk for receiving an off-set annular flange on the inner end of said blade retaining plate. A split retainer ring extends from a second groove intersecting said first groove to fix the blade retainer ring to the disk. A locking ring is positioned between said split retainer ring and said blade retaining plate to maintain said split retainer ring in its groove.

5 Claims, 3 Drawing Figures

ROTOR DISK COVER PLATE ATTACHMENT

The Government has rights in the invention pursuant to Contract No. F33657-82-C-0003 awarded by the Department of the Air Force.

DESCRIPTION

1. Technical Field

This invention relates to an attachment for fixing a blade retaining cover plate to a rotor disk for preventing axial movement of blades positioned in slots around the periphery of said rotor disk.

2. Background Art

Many currently-used blade retaining cover plates are secured to the rotor disk by bolting, said bolts extending into threaded holes passing partially into the web of the rotor disk or extending through holes extending entirely through the disks with nuts being placed on the opposite side. This type of attachment places highly stressed bolt holes in the disk web. Patents which show boltless rotor disk covers are U.S. Pat. Nos. 4,171,930 and 4,304,523.

DISCLOSURE OF INVENTION

One object of the present invention is an improved device for attaching a blade retaining plate to a rotor disk without placing a bolt hole through the web of the disk. The rotor disk includes a first annular groove receiving an annular projection at the inner end of the blade retaining plate, a split retainer ring is positioned in a second annular groove intersecting said first annular groove to overlap said annular projection to fix said annular projection in said groove in said rotor disk, cylindrical locking means being positioned between said split retainer ring and said blade retaining plate to lock or maintain said plate on said rotor disk by preventing removal of said split retainer ring during rotation by centrifugal force or other forces.

Another object of the present invention is to provide a split retainer ring having a cross-section which provides for an annular extension extending outside of the second annular groove away from the annular projection of said blade retaining plate in the first annular groove. This projection greatly reduces the tendency of a ring of uniform cross-section to roll out of a groove under load by placing a counteracting force on the ring. This, in combination with the cylindrical locking means or projection, provides a positively retained, uniformly loaded, low-stress, blade retaining plate retention device which is easily installed and easily disassembled.

BEST MODE FOR CARRYING OUT THE INVENTION

Figure 1:
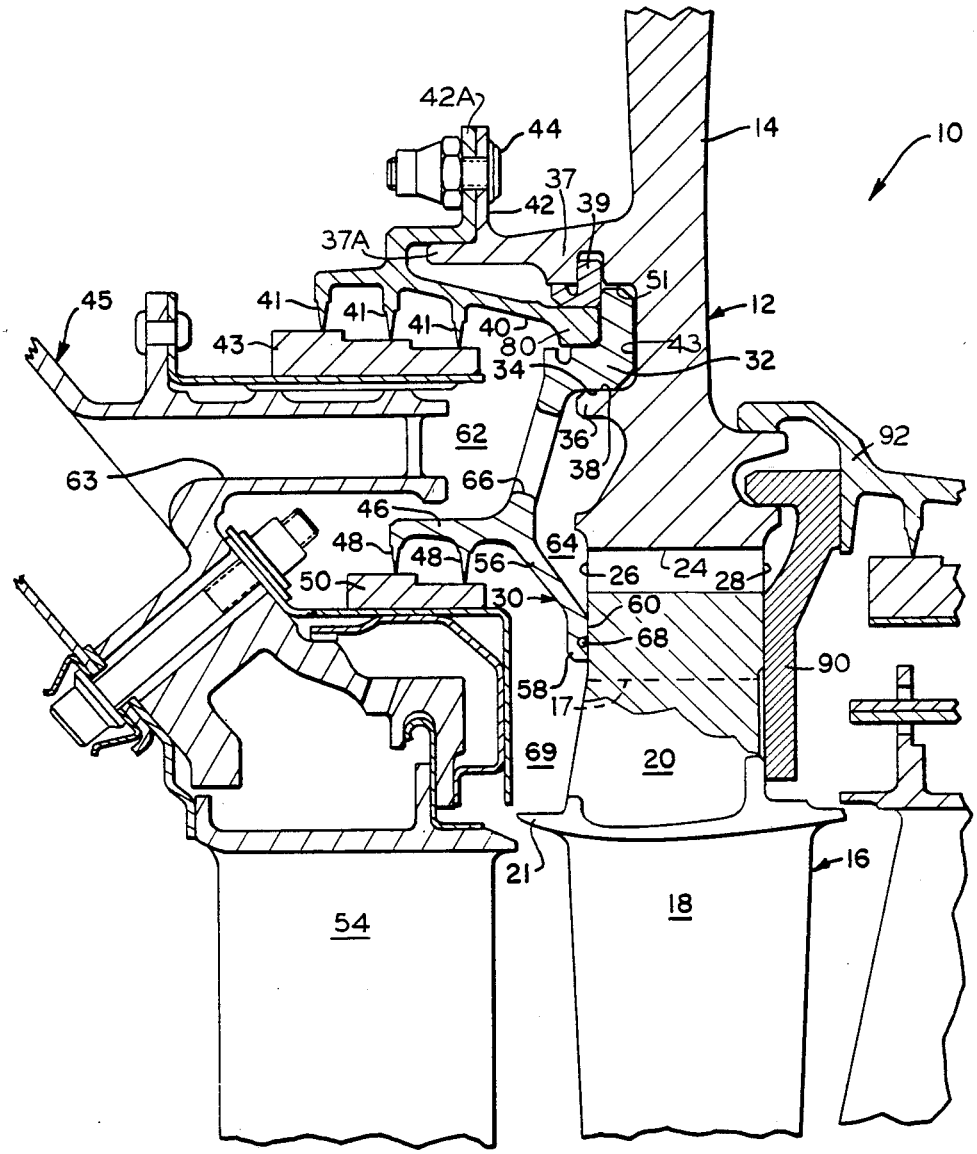
FIG. 1 is a sectional view taken through a portion of the turbine section of a gas turbine engine.
Figure 2:
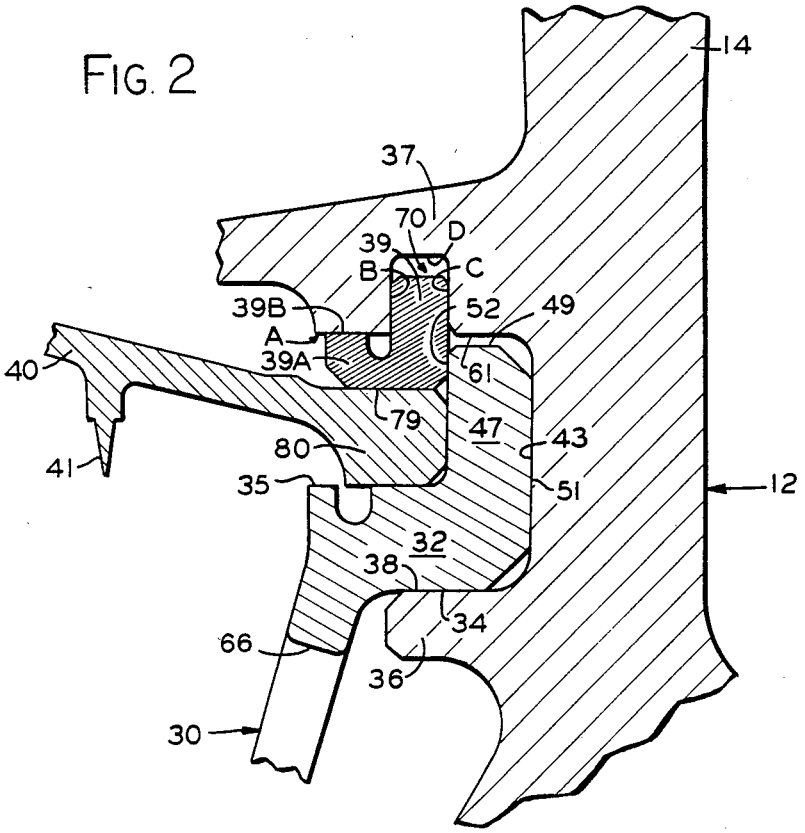
FIG. 2 is an enlarged view of the blade retaining cover plate attachment showing details of the present invention.
Figure 3:
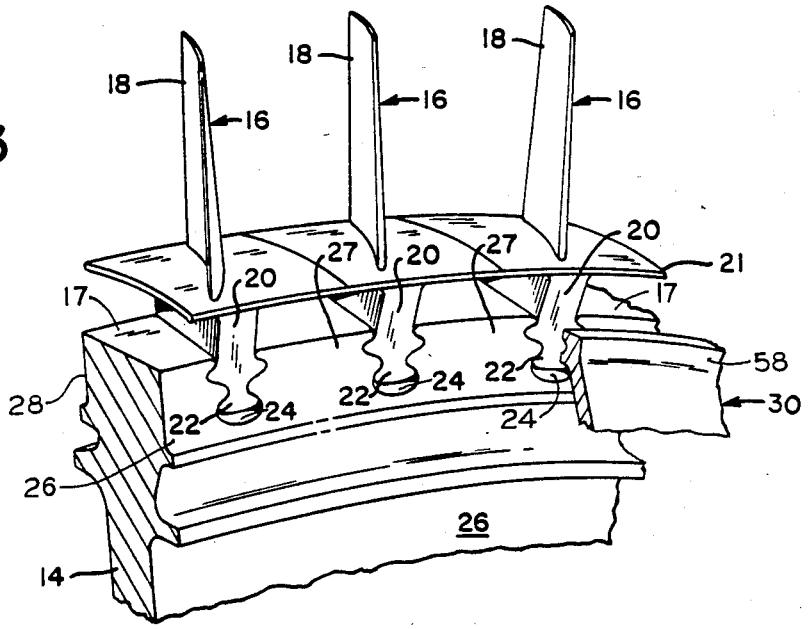
FIG. 3 is a perspective view showing the relationship of the blade roots, rotor disk and outer annular end of the blade retaining plate.

As an exemplary embodiment of the present invention, consider the portion of a gas turbine engine rotor assembly generally represented by the reference numeral 10 in FIG. 1. The rotor assembly 10 comprises a rotor 12 which includes a disk 14 having a plurality of blades 16 circumferentially spaced about the periphery 17 thereof. Each blade 16 comprises an airfoil portion 18 having a root portion 20 and platform 21 integral therewith. The root portion 20 can include a conventional fir tree shaped end 22, each end being disposed in a similarly shaped fir tree slot 24, a plurality of which extend around the periphery 17 of the disk 14 and which extend axially through the disk 14 from the disk front surface 26 through to the disk rear surface 28. The slots 24 are formed between what are herein referred to as disk lugs 27.

The disk 14 is secured to a shaft (not shown) by conventional means (not shown). The axis of the shaft is the axis of the engine about which the rotor assembly 10 rotates.

The rotor assembly 10 includes an annular blade retaining plate 30 secured to the front side of the disk 14. In this embodiment, the radially inner annular end of the plate 30 includes an axially rearwardly extending cylindrical flange 32 which has an outwardly facing cylindrical surface 34 and an inwardly facing cylindrical surface 35. The front side of the disk 14 includes a first axially forwardly extending annular portion 36 having an inwardly facing cylindrical surface 38. The outwardly facing cylindrical surface 34 mates tightly with the inwardly facing cylindrical surface 38 to orient the blade retaining plate 30 radially relative to the disk 14. The front side of the disk 14 includes a second axially forwardly extending annular portion 37 located radially inwardly of annular portion 36, said annular portion 37 having an outwardly facing cylindrical surface 61 which faces inwardly facing cylindrical surface 38.

The rearward ends of the cylindrical surfaces 38 and 61 are aligned and are connected by an annular surface 43 to form a forwardly facing annular groove A. The axially rearwardly extending cylindrical flange 32 has a inwardly extending annular flange 47 at its rearward end, extending inwardly from the rearward end of inwardly facing cylindrical surface 35, said inwardly extending annular flange 47 having an inner end surface 49, a rearwardly facing annular surface 51, and a forwardly facing annular surface 52. Said inner end surface 49 of said annular flange 47 faces the rearward part of outwardly facing cylindrical surface 61 of annular portion 37 while the rearwardly facing annular surface 51 is placed in contact with the annular surface 43, to orient the blade retaining plate 30 axially relative to the disk 14.

To lock, or maintain, the inwardly extending annular flange 47 in place, along with the remainder of the annular blade retaining plate 30, an annular groove 70 is placed in the outwardly facing cylindrical surface 61 of annular portion 37. Said annular groove 70 having a rectangular cross-section with forward and rearward annular surfaces B and C, respectively, and bottom surface D. Rearward annular surface C is formed in said annular portion 37 to intersect cylindrical surface 61 in alignment with the forwardly facing annular face 52 of annular flange 47 when it is in its properly mounted position.

A split retainer ring 39 is positioned in the annular groove 70 by being expanded to fit over cylindrical surface 61 and allowed to relax to its designed ring size having sliding engagement with forward and rearward annular surfaces B and C, and being slightly spaced from bottom surface D. Relaxed split retainer ring 39 projects outwardly from the annular groove 70 to have its rearward projecting annular side contact forwardly facing annular face 52 of annular flange 47. The forward projecting side of split retainer ring 39 has a forwardly extending cylindrical portion 39A with an inwardly facing cylindrical surface 39B engaging the forward part of cylindrical surface 61. This additional portion 39A tends to decrease the tendency of the split retainer ring 39 to roll forwardly out of groove 70 when rotating during operation when an axial forward load is placed on surface C by flange 47, since the portion 39A, when rotating, has a centrifugal force which places a counteracting force on said split retainer ring 39 to rotate said ring 39 in the opposite direction to said forward roll.

The split retainer ring 39 has an outwardly facing cylindrical surface 79 facing inwardly facing cylindrical surface 35 of the annular blade retaining plate 30. To prevent the split retainer ring from improperly coming out of annular groove 70 by centrifugal force or any other action, an annular projection 80 is placed between the inwardly facing cylindrical surface 35 of the blade retaining plate 30 and the outwardly facing cylindrical surface 79 of the split retainer ring 39. The annular projection 80 is fixed to an annular housing member 40 which is fixed to a cylindrical portion 37A at the outer end of forwardly extending annular portion 37. In this construction, the intermediate portion of the annular housing member 40 is formed as a labyrinth seal member having a plurality of conventional, outwardly extending knife edges 41 which are in sealing relationship to a stationary annular seal land 43 secured to stationary structure 45. While the annular housing member 40 has been shown fixed to the cylindrical portion 37A by mating annular flanges 42 and 42A, other fixing means can be used. Bolts 44 are shown holding the flanges together in this modification.

The plate 30 also includes an axially forwardly extending cylindrical seal member 46 integral therewith and which carries a plurality of conventional, radially outwardly extending knife edges 48. The knife edges 48 are in sealing relationship with a stationary annular seal land 50 secured to the stationary structure 45. The stationary structure 45 cooperates with a first stage of stator vanes 54 disposed upstream of the blades 16.

The plate 30 further includes a frusto-conical portion 56 extending radially outwardly in a downstream direction. The frusto-conical portion 56 has a radially outer end 58. The end 58 includes an annular surface 60 facing axially downstream which abuts the front surface 26 of the disk 14 and the forward ends of the blade root portions 20. Seal means 68 can be placed in annular surface 60. Any blade retaining means 90 can be provided on the rearward side of the rotor 12. A simplified blade retaining cover plate 90 is shown in FIG. 1, positioned between the rear surface 28 of the disk 14 and the rearward ends of the blade root portions 20 and a spacer 92.

As can be seen in the drawing, the seal members 40,46, the plate 30, and the stationary structure 45 define an inner annular compartment 62 which is fed cooling air from a plurality of circumferentially spaced apart nozzles 63. The plate 30, between its inner and outer ends, stands away from the disk front surface 26 defining an annular cooling air space 64 which, through large holes 66 in the plate 30 communicates with and is, in effect, a part of the compartment 62. Cooling air from space 64 can be directed through the disk 14 for use downstream of the disk 14 or can be directed for cooling the blade 16.

Although the invention has been shown and described with respect to a preferred embodiment thereof, it should be understood by those skilled in the art that other various changes and omissions in the form and detail thereof may be made therein without departing from the spirt and the scope of the invention.

We claim:

1. A device for securing a blade retaining plate to a rotor disk wherein said disk includes a forwardly facing annular groove, said groove having a forwardly facing annular bottom surface and an inwardly facing cylindrical surface and an outwardly facing cylindrical surface, said outwardly facing cylindrical surface having an outwardly facing annular groove therein spaced forwardly from said bottom surface, the inner end of said blade retaining plate having an off-set annular flange, said off-set annular flange having a forwardly facing annular face and a rearwardly facing annular face, said blade retaining plate having an outwardly facing cylindrical surface outwardly of said off-set annular flange, said outwardly facing cylindrical surface of said blade retaining plate engaging said inwardly facing cylindrical surface of said forwardly facing annular groove, said off-set annular flange having its rearwardly facing annular face positioned against the annular bottom surface of said forwardly facing annular groove, a split retainer ring being positioned in said outwardly facing annular groove and projecting outwardly thereof into the forwardly facing annular groove where it engages the forwardly facing annular face of the off-set annular flange to maintain it in said forwardly facing annular groove, a locking means being positioned between said split retainer ring and said blade retaining plate to maintain said split retainer ring in said outwardly facing annular groove.

2. A combination as set forth in claim 1 wherein said blade retaining plate has an inwardly facing cylindrical surface radially outward of said outwardly facing annular groove, said split retainer ring positioned in said outwardly facing annular groove having an outwardly facing cylindrical surface, said locking means being positioned between the outwardly facing cylindrical surface of said split retainer ring and the inwardly facing cylindrical surface of said blade retaining plate.

3. A combination as set forth in claim 1 wherein said outwardly facing annular groove divides said outwardly facing cylindrical surface of said forwardly facing annular groove into two parts, a forward cylindrical surface part and a rearward cylindrical surface part, said split retainer ring having a forwardly projecting flange at the outer end of the split retainer ring which engages the forward cylindrical surface part of said outwardly facing cylindrical surface of said forwardly facing annular groove.

4. A combination as set forth in claim 1 wherein said locking means comprises an annular ring positioned between the outwardly facing cylindrical surface of said split retainer ring and the inwardly facing cylindrical surface of said blade retaining plate.

5. A combination as set forth in claim 4 including means for fixedly attaching said annular ring to said rotor disk.

* * * * *